US009366423B2

(12) United States Patent
Park et al.

(10) Patent No.: US 9,366,423 B2
(45) Date of Patent: Jun. 14, 2016

(54) LED ILLUMINATION DEVICE

(71) Applicant: SOLECO CO., LTD., Funabashi-shi, Chiba (JP)

(72) Inventors: Jongkook Park, Funabashi (JP); Taro Okamoto, Atsugi (JP); Kazuhiro Katou, Funabashi (JP); Mitsuyoshi Ishikawa, Tokyo (JP)

(73) Assignee: Soleco Co., Ltd., Chiba (JP)

( * ) Notice: Subject to any disclaimer, the term of this patent is extended or adjusted under 35 U.S.C. 154(b) by 46 days.

(21) Appl. No.: 14/346,141

(22) PCT Filed: Sep. 19, 2012

(86) PCT No.: PCT/JP2012/005943

§ 371 (c)(1),
(2) Date: Mar. 20, 2014

(87) PCT Pub. No.: WO2013/042351

PCT Pub. Date: Mar. 28, 2013

(65) Prior Publication Data

US 2014/0233233 A1 Aug. 21, 2014

(30) Foreign Application Priority Data

Sep. 21, 2011 (JP) ..... 2011-205587

(51) Int. Cl.

| | |
|---|---|
| ***F21V 29/00*** | (2015.01) |
| ***F21K 99/00*** | (2016.01) |
| ***F21V 29/77*** | (2015.01) |
| *F21S 8/02* | (2006.01) |
| *F21S 8/04* | (2006.01) |

(Continued)

(52) U.S. Cl.

CPC . *F21V 29/30* (2013.01); *F21K 9/30* (2013.01); *F21V 29/004* (2013.01);

(Continued)

(58) Field of Classification Search

CPC ..... F28D 2021/0028; F28D 2021/0031; F28D 15/0233; F28D 2021/0029; F21K 9/00; F21V 7/00; F21V 29/30; F21V 29/50; F21V 29/004; F21V 29/20; F21V 29/2206; F21V 29/763; F21V 29/74; F21V 29/2212; F21V 31/00; F21V 19/001; F21V 23/006; F21V 23/007; F21V 29/00; F21V 29/508; F21V 29/56; F21V 29/745; F21V 29/767; F21V 3/00; F21V 5/007; F21V 7/22; F21Y 2101/02; F21Y 2105/001

USPC ..... 362/157, 183, 184, 200, 202, 208, 218, 362/240, 241, 249.01, 249.02, 29, 4, 318, 362/328, 373, 544, 545, 546, 547

See application file for complete search history.

(56) References Cited

U.S. PATENT DOCUMENTS

| | | | | |
|---|---|---|---|---|
| 7,547,124 | B2 * | 6/2009 | Chang et al. | 362/373 |
| 7,740,380 | B2 * | 6/2010 | Thrailkill | 362/294 |

(Continued)

FOREIGN PATENT DOCUMENTS

| | | | |
|---|---|---|---|
| JP | 3121916 | U | 5/2006 |
| JP | 2006-210537 | A | 8/2006 |

(Continued)

*Primary Examiner* — Hargobind S Sawhney

(74) *Attorney, Agent, or Firm* — Carrier Blackman & Associates, P.C.; Joseph P. Carrier; Anne G. Sabourin

(57) ABSTRACT

Disclosed is an LED illumination device of a simple configuration, capable of suppressing thermal resistance to a low level, and of effectively dissipating heat generated from LED elements. Rigidity of a mounting plate is ensured by a wall of a certain height, and thereby the mounting plate now becomes possible to endure saturation vapor pressure of a coolant liquid possibly exerted thereon, and vacuum state or near-vacuum state when the coolant liquid is injected, without being deformed. Since the rigidity of the mounting plate is ensured by the wall, a wall composing a bottom face of recesses may now be thinned, and this is advantageous in view of allowing the heat generated from the LED elements to effectively conduct to the coolant liquid, and of effectively cooling the LED elements.

6 Claims, 6 Drawing Sheets

(51) Int. Cl.
*F21W 131/101* (2006.01)
*F21Y 101/02* (2006.01)
*F21Y 105/00* (2016.01)

(52) U.S. Cl.
CPC ..... *F21V 29/773* (2015.01); *F21S 8/02* (2013.01); *F21S 8/04* (2013.01); *F21W 2131/101* (2013.01); *F21Y 2101/02* (2013.01); *F21Y 2105/001* (2013.01)

(56) References Cited

U.S. PATENT DOCUMENTS 7,819,556 B2 * 10/2010 Heffington et al. ..... 362/294
8,692,444 B2 * 4/2014 Patel et al. ..... 313/46
8,934,248 B2 * 1/2015 Thrailkill ..... 361/710
2008/0093962 A1 * 4/2008 Kim et al. ..... 313/46
2010/0128479 A1 5/2010 Biebl et al.
2012/0170263 A1 * 7/2012 Rodriguez ..... 362/230
2012/0206927 A1 8/2012 Miyahara
2012/0268936 A1 * 10/2012 Pickard et al. ..... 362/249.02

FOREIGN PATENT DOCUMENTS

JP 2009-064661 A 3/2009
JP 2010-010128 A 1/2010
JP 2010-524210 A 7/2010
JP 2010-267435 A 11/2010
JP 2011-165703 A 8/2011
WO 2011-055659 A1 5/2011

* cited by examiner

LED ILLUMINATION DEVICE

TECHNICAL FIELD

The present invention relates to an illumination device using LED (Light Emitting Diode), and in particular to an illumination device incorporated with a heat sink.

BACKGROUND ART

Illumination device using LED has been disseminated as one solution for addressing recent subjects on energy saving. LED is characterized by its low power consumption and long service life, and is said to be a fast-evolving semiconductor device, with relevant technologies under investigation worldwide.

While LED in the early days have been limitedly applied to low-power-consumption appliances such as indicator lamp and so forth, there have emerged in recent years high-output illumination devices which incorporate high-output LED elements having been developed. The LED illumination devices are very high in illumination effect, and some of them surpass fluorescent lamps. By virtue of straightness of illumination, LED has high illuminance value relative to the total luminous flux, and can emit strong light. LED is also expected to operate over 60,000 hours if used under optimum conditions.

With such numerous advantages of the illumination devices using LED, problems however arise due to large heat generation from the high-output LED. For example, heat generated from the LED element needs to be dissipated effectively, in order to prevent the LED element from degrading.

Accordingly, there have been known LED illumination devices configured to have a substrate having mounted thereon LED elements for illumination, a base for fixing the substrate, and a heat pipe or a heat sink composed of radiation fin or the like, which transfers heat generated from the LED.

CITATION LIST

Patent Literature

Patent Literature 1: JP-A-2010-267435
Patent Literature 2: JP-A-2009-64661
Patent Literature 3: JP-A-2006-210537

SUMMARY OF THE INVENTION

Problems to be Solved by the Invention

As described above, the conventional LED illumination devices have various constituents including a base for fixing the substrate having the LED elements mounted thereon, heat pipe and radiation fin. This has complicated the structure.

For efficient dissipation of heat generated from the LED elements, the heat pipe is preferably in good adherence with the constituent adjoining thereto. It is, however, difficult in practice to configure the components with high adherence, due to differences in materials and geometries.

It has also been difficult to suppress thermal resistance of the heat sink, typically due to difference in materials between the heat pipe and the individual constituents. In view of making the heat sink more suitable to recent high-output LED illumination devices, it has been demanded to reduce the thermal resistance of the heat sink for the LED elements to a level lower than before, and to dissipate heat generated from the LED elements more effectively than the current level.

The present invention was conceived in consideration of the situation described above, and an object thereof is to provide an LED illumination device which is capable of suppressing the thermal resistance to a level lower than the conventional level, and of efficiently dissipating heat generated from the LED elements.

Means for Solving the Problems

According to the present invention aimed at achieving the object, there is provided an LED illumination device which includes:

an illumination section which has a substrate with a plurality of LED elements mounted thereon, and a supporting component which supports the substrate; and a cooling section which supports and cools the supporting component.

The supporting component has a mounting plate with one surface appeared in the thickness-wise direction configured as a mounting surface on which the substrate is attached, and with the other surface appeared in the thickness-wise direction configured as a rear face.

The cooling section includes:

a cooling cylinder of a certain length, with one longitudinal end opened and with the other longitudinal end closed;

an inner space formed in the cooling cylinder, as a result of closure at one end of the cooling cylinder by the rear face; and a coolant liquid filled in the inner space.

The supporting component is supported at one end of the cooling cylinder.

The plurality of mounted LED elements are located inside the range of the rear face located in the inner space, when viewed in the direction of thickness of the mounting plate.

A large number of discrete recesses, each concaving towards the mounting surface, are formed in a honeycomb pattern over the entire rear face located in the inner space.

Effects of the Invention

Heat generated from the LED illumination device during the operation is allowed to conduct, after passing through the substrate, from the mounting surface to the mounting plate, and further from the mounting plate to the coolant liquid.

Upon conduction of heat to the coolant liquid, the coolant liquid readily evaporates, and heat of the vaporized coolant liquid is allowed to conduct to the cooling cylinder, and to dissipate to the outside.

As a result of dissipation of heat of condensation at the top portion of the inner space, the coolant liquid is cooled and condensed, and returned by gravity back on the mounting plate. Such circulation of the coolant liquid continues.

In the present invention, rigidity of the mounting plate is ensured by a wall of a certain height positioned between every adjacent recess, and thereby the mounting plate now becomes possible to endure saturation vapor pressure of the coolant liquid, and vacuum state or near-vacuum state when the coolant liquid is injected, without being deformed. Since the rigidity of the mounting plate is ensured by the wall of a certain height positioned between every adjacent recess, a wall composing the bottom face of the recesses may now be thinned.

In the present invention, when viewed in the thickness-wise direction of the mounting plate, all LED elements fall within the range of the rear face located in the inner space, and the wall which composes the bottom face of the recesses is thin.

Accordingly, the configuration is much advantageous in view of allowing heat generated from all of the LED elements to conduct effectively, through the thin wall which configures the bottom face of the recesses, to the coolant liquid, and in view of effectively cooling all of the LED elements.

DESCRIPTION OF EMBODIMENTS

The paragraphs below will explain embodiments of the present invention referring to illustrated examples.

Figure 1:
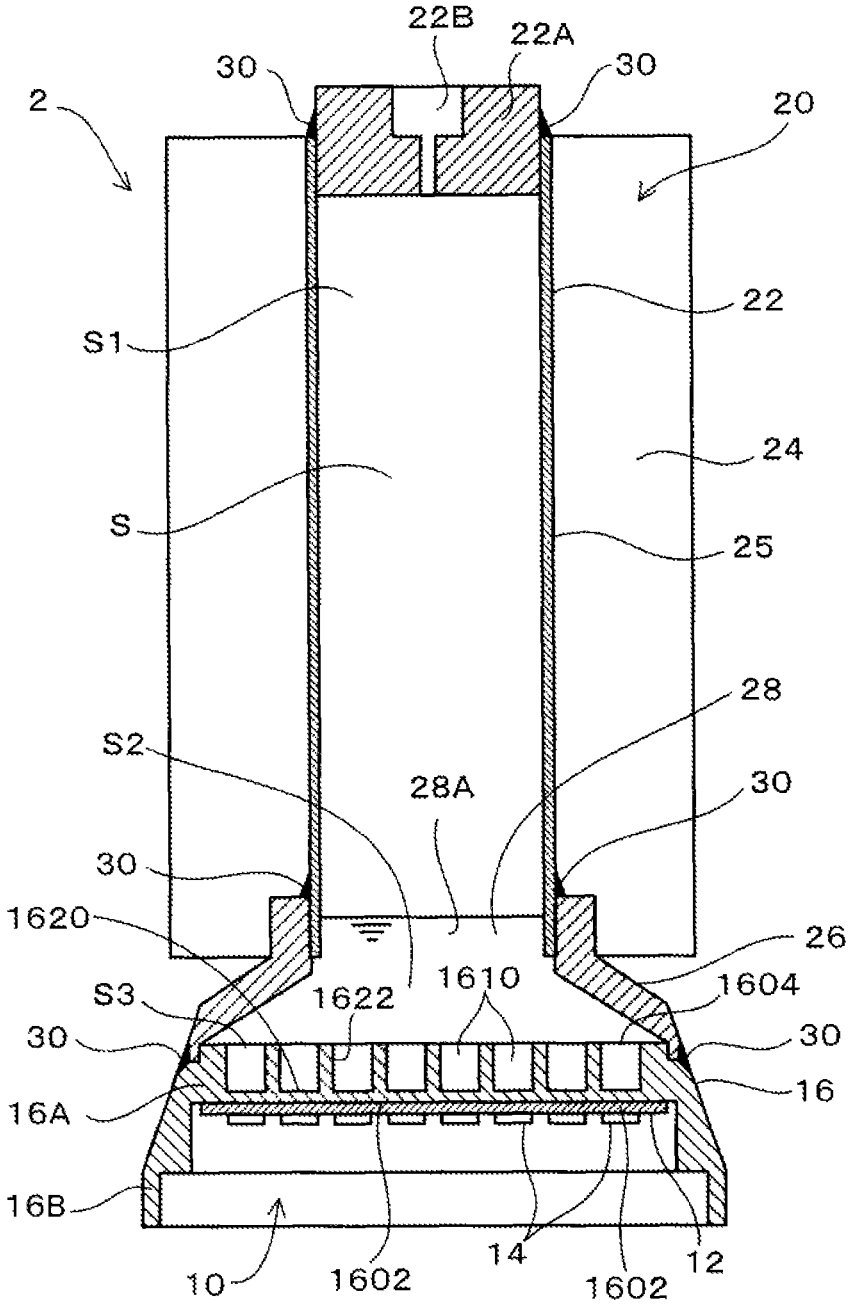
[FIG. 1] A front cross-sectional view illustrating an LED illumination device of one embodiment, taken along the line X-X in FIG. 2.
Figure 2:
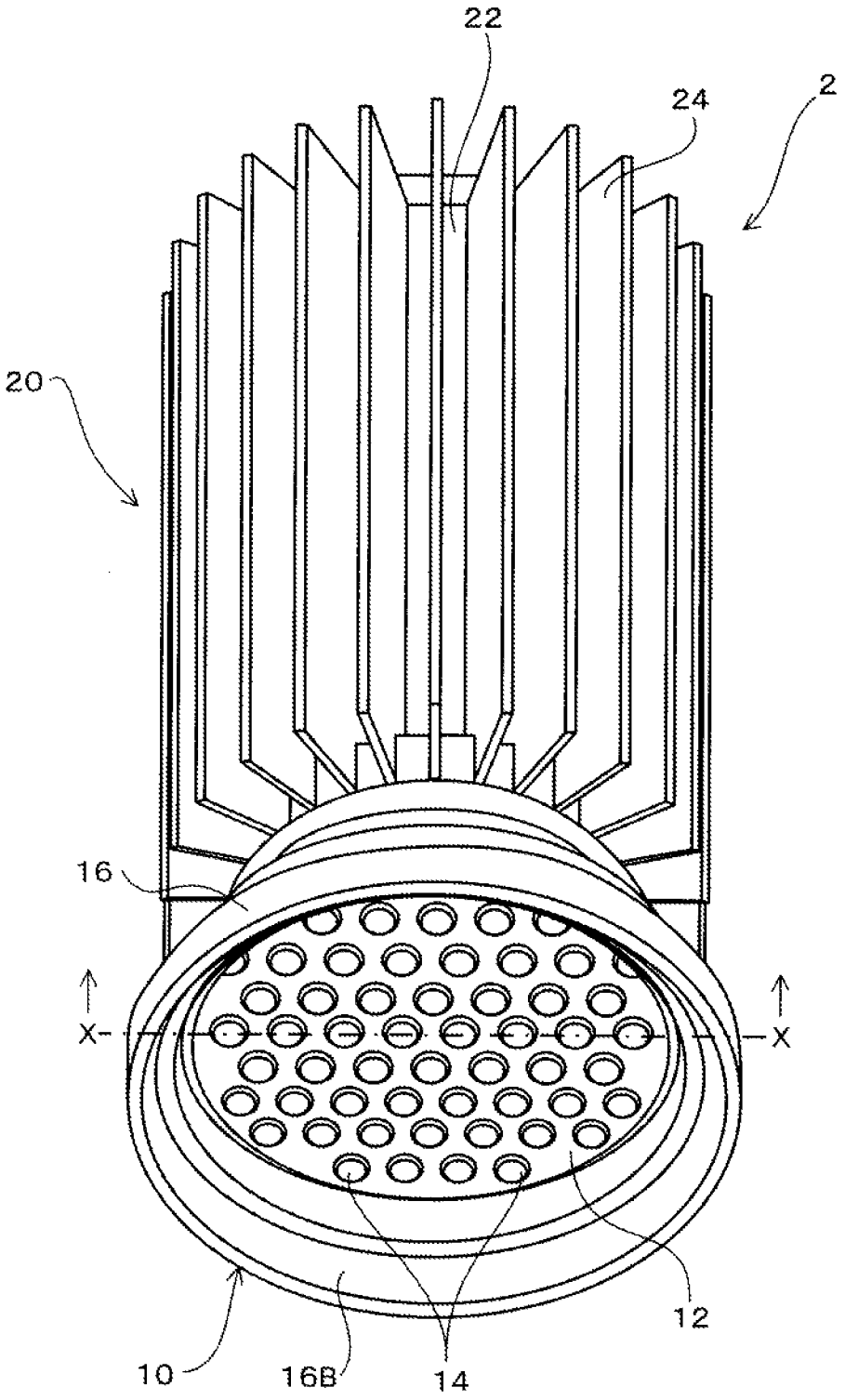
[FIG. 2] A perspective view illustrating an LED illumination device of the embodiment, viewed from the side of the illumination section.
Figure 3:
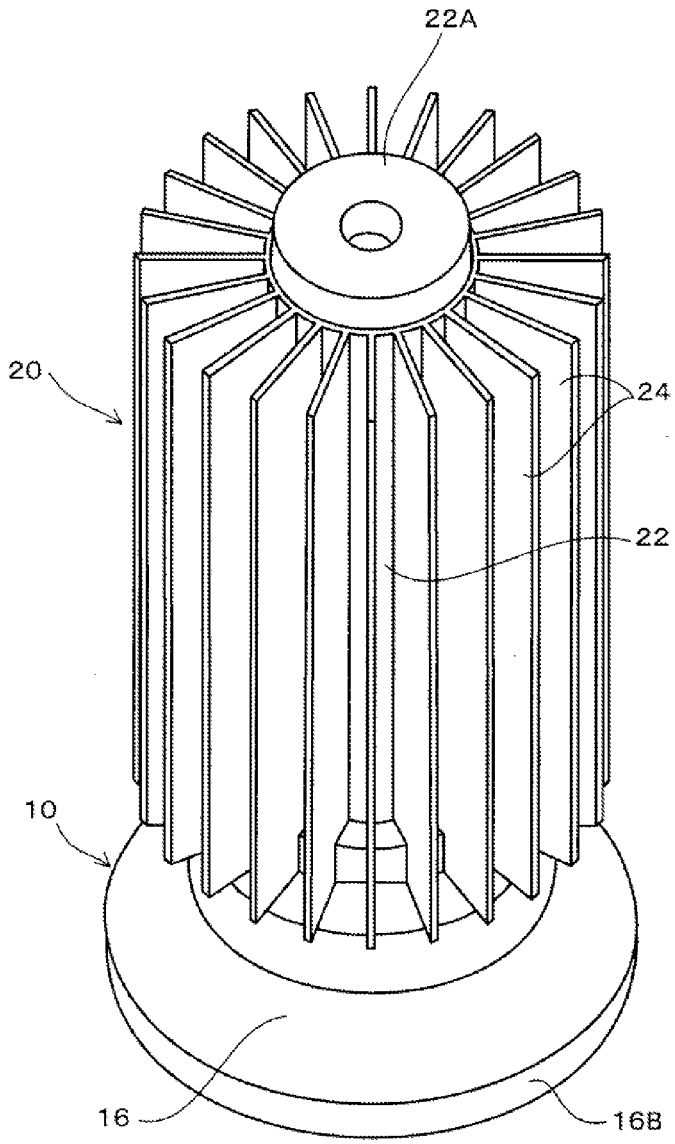
[FIG. 3] A perspective view illustrating an LED illumination device of the embodiment, viewed from the side of the cooling section.

As is understood from FIG. 1 to FIG. 3, an LED illumination device 2 of one embodiment has an illumination section 10, and a cooling section 20 which supports the illumination section 10, and is configured to cool a plurality of LED elements 14 of the illumination section 10, with the aid of heat of vaporization of a coolant liquid 28 filled in the inner space S of the cooling section 20.

The LED illumination device 2 of the embodiment illustrated in FIG. 1 to FIG. 6 is used, while being supported in a direction so that LED illumination light is cast downward in the perpendicular direction.

Assuming now that a location of use is a tunnel, the LED illumination devices 2 are disposed on the top wall and/or side wall in the tunnel, meanwhile assuming that a location of use is a building, they are disposed on the ceiling and/or wall. Any publicly-known fittings such as hooks, necessarily provided to the cooling section 20 or the illumination section 10 are not illustrated in the drawings.

The illumination section 10 is configured to contain a substrate 12, the LED elements 14, and a supporting component 16.

In this embodiment, the substrate 12 has a circular form, on which the plurality of LED elements 14 are mounted.

The supporting component 16 is configured to contain a mounting plate 16A and a reflector 16B.

Figure 5:
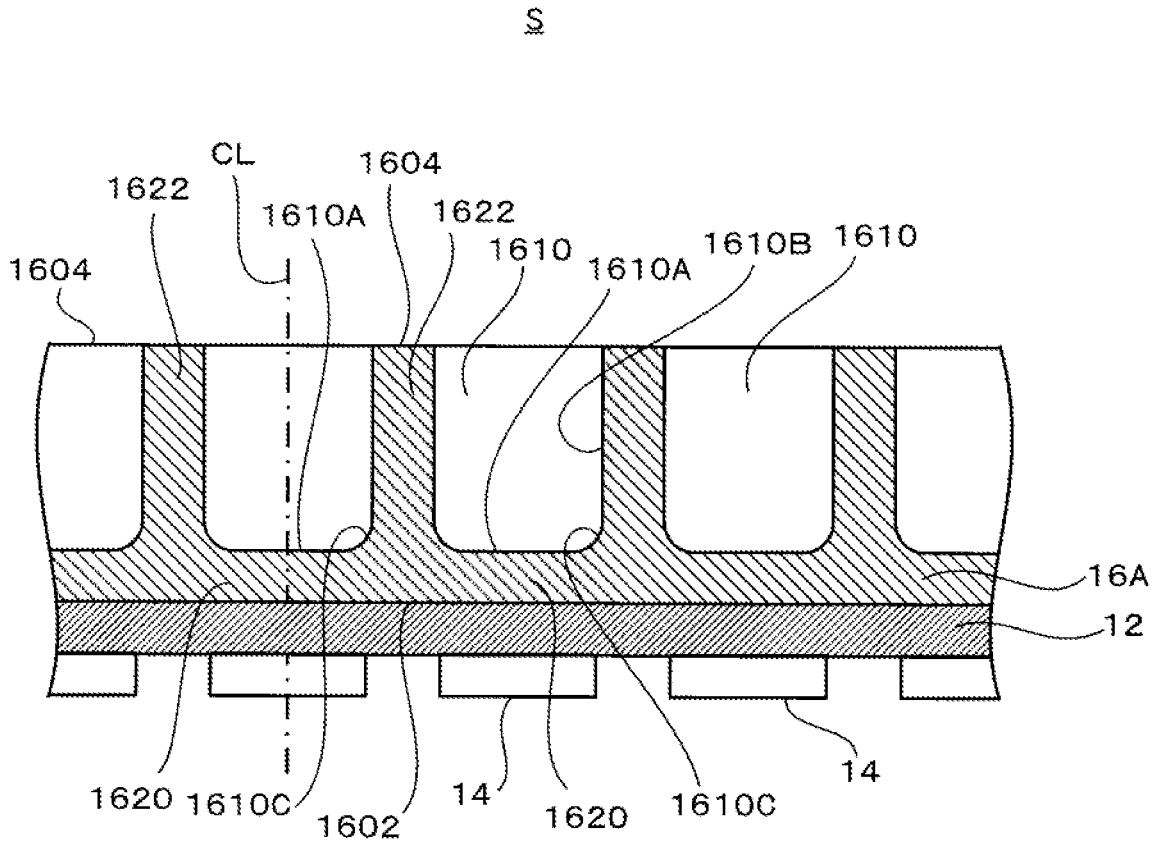
[FIG. 5] An enlarged cross-sectional view illustrating the mounting plate.
Figure 6:
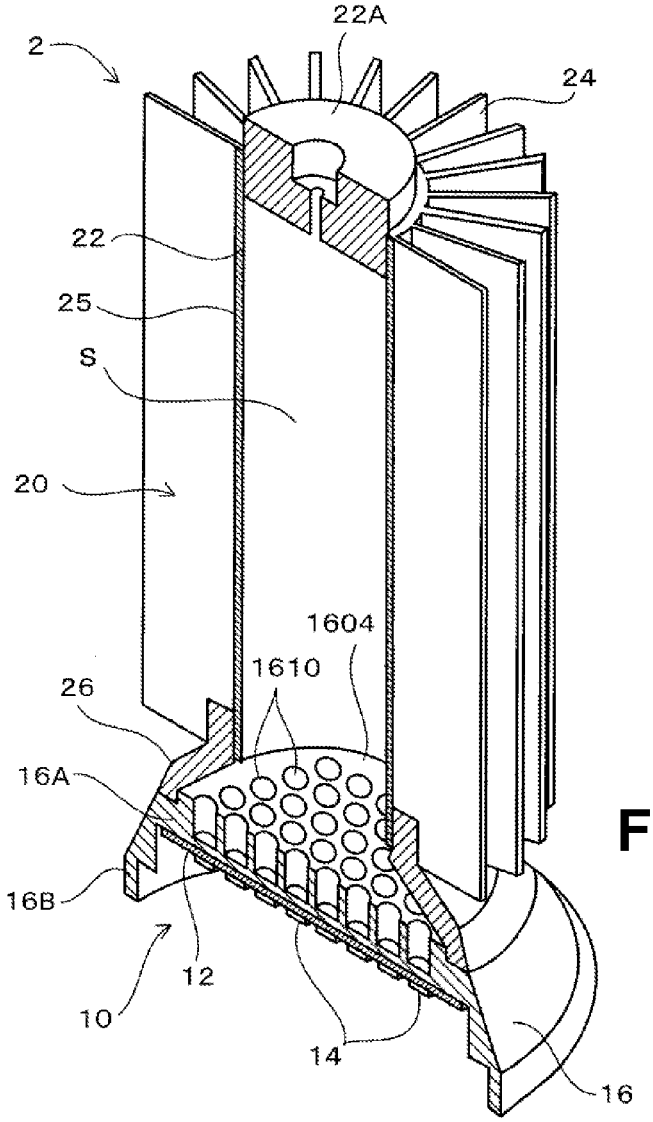
[FIG. 6] A perspective cross-sectional view illustrating the LED illumination device of the embodiment, viewed from the side of the cooling section.

The mounting plate 16A has a circular form, and as illustrated in FIG. 5, one surface of the mounting plate 16A which appears in the thickness-wise direction configures a mounting surface 1602 on which the substrate 12 is attached, and the other surface which appears in the thickness-wise direction configures a rear face 1604.

The mounting plate 16A, while being kept horizontally, supports on the mounting surface 1602 thereof the substrate 12 from the upper side in the perpendicular direction, to thereby direct the plurality of LED elements 14, mounted on the substrate 12, downward in the perpendicular direction.

The reflector 16B is provided on the circumference of the mounting plate 16A so as to surround the substrate 12.

The reflector 16B condenses, by reflection, the illumination light emitted from the LED elements 14, and casts light of a desired illumination dose.

In this embodiment, a large number of discrete recesses 1610, each concaving towards the mounting surface 1602, are formed in a honeycomb pattern over the entire area of the rear race 1604 of the mounting plate 16A located in the inner space S. In other words, the large number of recesses 1610 are formed in a juxtaposed manner.

In this embodiment, each recess 1610 has a circular cross section.

Accordingly, as illustrated in FIG. 5, the mounting plate 16A has a wall 1620 located between a bottom face 1610A of the large number of recesses 1610 and the mounting surface 1602, and a wall 1622 which extends from the mounting surface 1602 to the rear face 1604 and positioned between every adjacent recess 1610.

Each recess 1610 has the bottom face 1610A, and a side face 1610B which rises up from the circumference of the bottom face 1610A to be connected to the rear face 1604.

In addition, in this embodiment, the boundary between the bottom face 1610A and the side face 1610B is connected by a concave curved face 1610C.

The plurality of LED elements 14 are arranged on the substrate 12 respectively at positions so that the centers thereof fall on the extended lines of the center axes CL of the recesses 1610.

With such configuration, the rigidity of the mounting plate 16A is ensured by a wall 1622 of a certain height, and thereby the mounting plate 16A now becomes possible to endure saturation vapor pressure of the coolant liquid 28 which exerts thereon, and vacuum state or near-vacuum state when the coolant liquid 28 is injected, without being deformed.

Since the rigidity of the mounting plate 16A is ensured by the wall 1622, so that the wall 1620 composing the bottom face 1610A of the recesses 1610 may now be thinned. This is much advantageous in view of allowing heat generated from the LED elements 14 to conduct effectively to the coolant liquid 28, and of effectively cooling the LED elements 14.

In this case, as illustrated in FIG. 5, by arranging the plurality of LED elements 14 on the substrate 12 respectively at positions which fall on the extended lines of the center axes CL of the recesses 1610, the heat generated from the LED elements 14 is allowed to conduct through the thin wall 1620 to the coolant liquid 28. This is more advantageous in view of effectively cooling the LED elements 14.

In addition, by arranging the plurality of LED elements 14 respectively so that the centers thereof fall on the extended lines of the center axes CL of the recesses 1610, the most part of heat generated from the LED elements 14 is allowed to conduct through the thin wall 1620 to the coolant liquid 28. This is still more advantageous in view of effectively cooling the LED elements 14.

In addition, as illustrated in FIG. 5, by providing the concave curved face 1610C at the boundary between the bottom face 1610A and the side face 1610B, stress possibly concentrated on the boundary between the bottom face 1610A and the side face 1610B, under the saturation vapor pressure of the coolant liquid 28 exerted thereon, may be moderated. This is advantageous in view of improving the durability of the mounting plate 16A.

Note that, depending on the mode of arrangement of the LED elements 14, several adjacent recesses 1610 may communicate, so long as the mounting plate 16A can remain mechanically durable.

The cooling section 20 supports the supporting component 16, and transfers and dissipates the heat generated from the LED elements 14 during operation of the LED illumination device 2. Accordingly, the cooling section 20 also acts as a heat sink having a function of heat pipe.

The cooling section 20 is configured to contain a cooling cylinder 22, radiation fins 24, the inner space S, and the coolant liquid 28.

The cooling cylinder 22 is opened at one longitudinal end, and the opened end is closed by the rear face 1604 of the mounting plate 16A.

At the other longitudinal end of the cooling cylinder 22, there is provided a plug-like seal 22A. A hole 22B of the seal 22A is closed, after the coolant liquid 28 is injected into the inner space S, by welding in a seamless manner as described later.

As a result of closure at one longitudinal end of the cooling cylinder 22 by the rear face 1604 of the mounting plate 16A, and at the other longitudinal end by the seal 22A, the inner space S is formed inside the cooling cylinder 22.

In this embodiment, the cooling cylinder 22 is configured to contain a cylindrical body 25, and a hollow interconnect component 26 which is attached to the longitudinal end of the cylindrical body 25, and supports the mounting plate 16A.

The radiation fins 24 extend over the entire length of the cylindrical body 25, and are provided on the outer circumferential surface of the cylindrical body 25 while being spaced from each other, in a manner integrated with the cylindrical body 25.

As seen in the LED illumination device 2 of the embodiment, when the diameter of the illumination section 10 is larger than the diameter of the cylindrical body 25, that is, when the area in which the plurality of LED elements 14 are disposed is larger than the sectional area of the cylindrical body 25, provision of the interconnect component 26 is advantageous in terms of tightly connecting the illumination section 10 and the cooling section 20.

The interconnect component 26 is shaped hollow, and has a base to be attached to the end of the cylindrical body 25, and a tapered portion gradually increased in diameter from the base.

Accordingly, the inner space S has a columnar space S1 which is sectioned in the cylindrical body and straightly extends while keeping a constant sectional area; and a conical space S2 which is formed inside the interconnect component 26, connected to the longitudinal end of the columnar space S1, and has a sectional area which gradually increases with distance from the columnar space S1.

A portion of the cooling section 20 supporting the supporting component 16 corresponds to the end of the interconnect component 26 which forms therein the conical space S2 on the side away from the columnar space S1, meanwhile the opened end of the cooling cylinder 22 closed by the rear face 1604 corresponds to the end of the conical space S2 on the side away from the columnar space S1.

Figure 4:
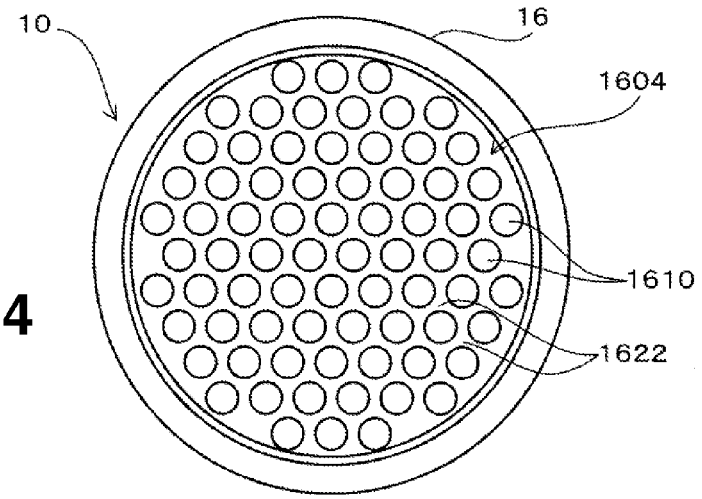
[FIG. 4] A plan view illustrating the illumination section before being attached to the interconnect component.

As illustrated in FIG. 1 and FIG. 4, as a result of provision of the interconnect component 26, now the mounting plate 16A can be provided so that the plurality of mounted LED elements 14 fall within the range of rear face 1604 located inside the inner space S when viewed in the thickness-wise direction of the mounting plate 16A, so as to efficiently cool all of the LED elements with the aid of heat of vaporization of the coolant liquid 28.

Figure 7:
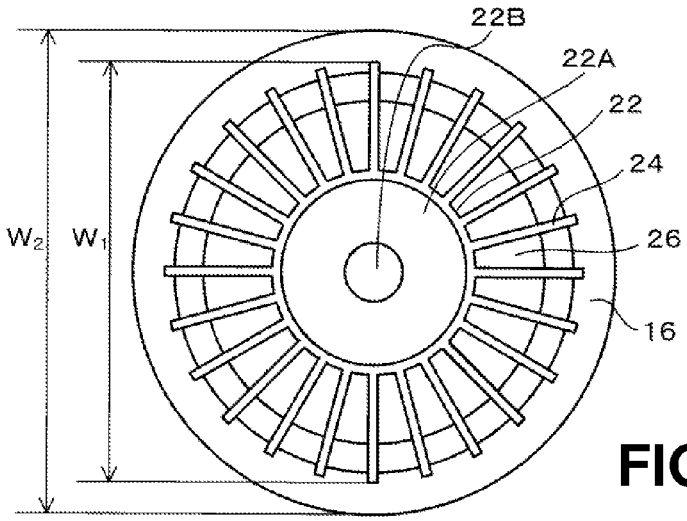
[FIG. 7] A plan view illustrating the LED illumination device of the embodiment.

The LED illumination device 2 of this embodiment 2 is configured as illustrated in FIG. 7, so that, when viewed in the axial direction of the cooling cylinder 22, the cooling section 20 including the radiation fins 24 falls within the range of the illumination section 10 including the supporting component 16. More specifically, the diameter W1 of the cooling section 20 including the radiation fins 24 is set not larger than the diameter W2 of the supporting component 16.

In short, in a plan view, the cooling section 20 including the plurality of radiation fins 24 is disposed so that the contour thereof falls within the contour of the illumination section 10.

The cylindrical body 25, the interconnect component 26, and the supporting component 16 are formed with a material showing high thermal conductivity, capable of enduring vacuum state when the coolant liquid 28 is injected, and also capable of enduring the saturation vapor pressure of the coolant liquid 28 during operation. For example, aluminum characterized by high thermal conductivity and light weight is preferable. When manufactured by die casting, they are advantageous in terms of reducing the cost.

Welding is used for attaching the seal 22A to the cylindrical body 25, attaching the cylindrical body 25 to the interconnect component 26, and attaching the interconnect component 26 to the supporting component 16, so that these components are kept in a gap-free state over a long term, and thereby the durability of the LED illumination device 2 is enhanced. Reference numeral "30" herein represents spots of welding.

Upon receiving heat resulted from light emission of the LED element 14, the coolant liquid 28 readily vaporizes and dissipates the heat, and thus ensures efficient heat transfer. Accordingly, the cooling section 20 also acts as a heat sink with a heat pipe function.

The coolant liquid 28 is filled as much to ensure that the entire range of the rear face 1604 of the mounting plate 16A is submerged in the coolant liquid 28 at all times, when the cooling cylinder 22 is held so as to direct the longitudinal direction thereof (more specifically, the longitudinal direction of the cylindrical body 25 of the cooling cylinder 22) in the perpendicular direction. In other words, the coolant liquid 28 is filled as much to ensure that a liquid pool 28A composed of the coolant liquid 28 resides at all times in a lower part of the inner space S, and the level of the liquid surface is kept over the entire range of the rear face 1604 of the mounting plate 16A at all times.

Various liquids publicly known, including water, alcohol, and highly-insulating inflammable liquid such as silicone oil, are usable for the coolant liquid 28.

Although depending on species of liquid to be used as the coolant liquid 28, the entire range of the rear face 1604 of the mounting plate 16A is submerged at all times under the coolant liquid 28, when the amount of filling thereof is approximately 15% of the inner space S. The coolant liquid 28 is filled, for example, up to the lower end of the columnar space S1.

The coolant liquid 28 is injected into the inner space S, while keeping the inner space S in a vacuum state or near-vacuum state, through the hole 22B of the seal 22A. After the injection, the hole 22B is sealed by welding in a gap-free manner.

Next, the operation will be explained.

The heat generated from the LED elements 14 during operation of the LED illumination device 2 is allowed to conduct, after passing through the substrate 12, from the mounting surface 1602 to the mounting plate 16A, and further from the mounting plate 16A to the coolant liquid 28 in the liquid pool 28A.

Upon given heat by conduction, the coolant liquid 28 readily vaporizes. The thus vaporized coolant liquid 28 ascends in the inner space S, heat of the vaporized coolant liquid 28 is allowed to conduct through the cooling cylinder 22 to the radiation fins 24, and is then allowed to dissipate from the radiation fins 24.

As a result of release of heat of condensation at the top portion of the inner space S, the coolant liquid 28 is cooled to be liquefied, returned back by gravity to the liquid pool 28A over the mounting plate 16A. Such circulation of the coolant liquid 28 continues.

In this embodiment, the cooling section 20 per se is configured as a heat sink which functions like a heat pipe for transferring and dissipating heat generated from the LED elements 14.

Accordingly, the LED illumination device 2 now becomes possible to efficiently dissipate the heat generated from the LED elements 14, despite its very simple structure as compared with that of the conventional LED illumination device, without anticipation of increase in the thermal resistance as a consequence.

In this embodiment, when viewed in the direction of thickness of the mounting plate 16A, all of the LED elements 14 fall inside the range of the rear face 1604 located in the inner space S, and the wall 1620 which configures the bottom face 1610A of the recesses 1610 is thin.

Accordingly, the configuration is much advantageous in terms of efficiently conducting the heat, generated from all of the LED elements 14, to the coolant liquid 28, to thereby effectively cool all of the LED elements 14.

Since the plurality of LED elements 14 are arranged on the substrate 12 respectively at positions which fall on the extended lines of the center axes CL of the recesses, the heat generated from the LED elements 14 is allowed to conduct through the thin wall 1620 to the coolant liquid 28. This is more advantageous in view of effectively cooling the LED elements 14.

In this case, by arranging the plurality of LED elements 14 respectively so that the centers thereof fall on the extended lines of the center axes CL of the recesses 1610, the most part of heat generated from the LED elements 14 is allowed to conduct through the thin wall 1620 to the coolant liquid 28. This is still more advantageous in view of effectively cooling the LED elements 14.

Since, in a plan view, the cooling section 20 including the plurality of radiation fins 24 is disposed so that the contour thereof falls within the contour of the illumination section 10, so that the LED illumination device 2 will become more convenient to handle.

For example, since the radiation fins 24 are configured so as not to excessively protrude out from the illumination section 10, so that the radiation fins 24 are less likely to fracture, and is less anticipated to degrade.

In addition, it will become easier to design, for example, components for covering the cooling section 20, so as to be fitted to the size of the illumination section 10.

In the process of shipping or storage, the LED illumination device 2 may be stacked or stored, simply by being wrapped using an appropriate cushion material adapted to the size of the illumination section 10, without fear of damaging the radiation fins 24.

Figure 8:
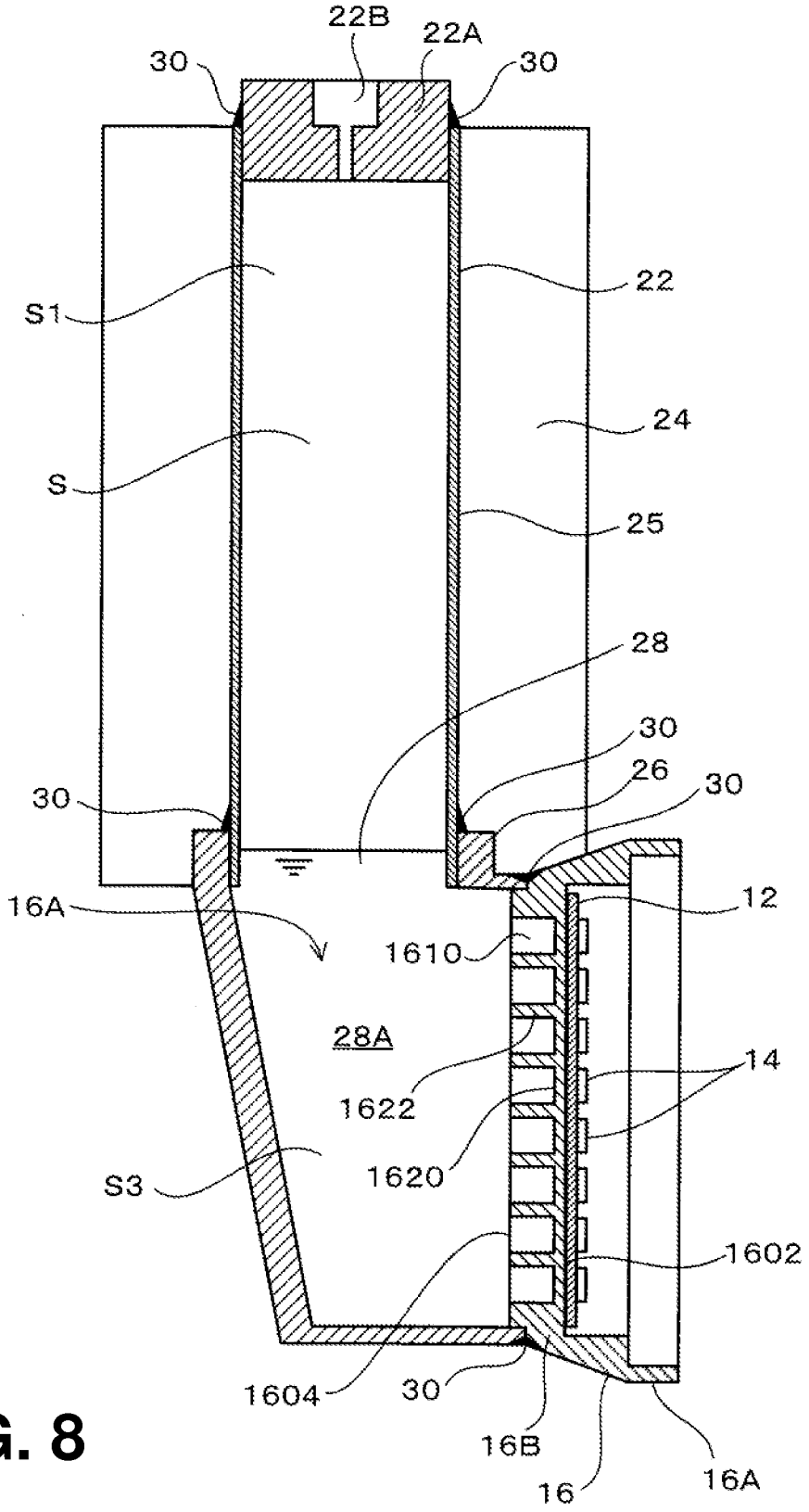
[FIG. 8] A front cross-sectional view illustrating an LED illumination device according to a modified example of the embodiment.

Next, a modified example of this embodiment will be explained referring to FIG. 8.

Note that all portions and components are given the same reference symbols and/or numerals with those in the embodiment described above.

In the embodiment described above, the cooling cylinder 22 was held so as to direct the longitudinal direction thereof in the perpendicular direction, with the rear face 1604 of the mounting plate 16A faced up in the perpendicular direction, and with the mounting surface 1602 and the LED elements 14 faced down in the perpendicular direction. In contrast, in this modified example, the cooling cylinder 22 is held so as to direct the longitudinal direction thereof in the perpendicular direction, with the rear face 1604, the mounting surface 1602, and the LED elements 14 faced obliquely with respect to the perpendicular direction.

Also in this modified example, the illumination section 10 is configured to contain the substrate 12, the LED elements 14, and the supporting component 16, and the cooling section 20 is configured to contain the cooling cylinder 22, the radiation fins 24, the interconnect component 26, the inner space S, and the coolant liquid 28.

The illumination section 10 and the radiation fins 24 are configured in the same way with those in the embodiment described above, only with a difference in the geometry of the interconnect component 26 configuring the cooling cylinder 22.

As seen in the LED illumination device 2 of this modified example, the interconnect component 26 is advantageously used to tightly connect the illumination section 10 and the cooling section 20, when the illumination is directed for example to the horizontal direction, which crosses the perpendicular direction, while holding the cooling cylinder 22 so as to direct the longitudinal direction thereof (more specifically, the longitudinal direction of the cylindrical body 25 of the cooling cylinder 22) in the perpendicular direction.

The cooling cylinder 22 is configured to contain the cylindrical body 25 and the interconnect component 26. The interconnect component 26 is shaped hollow, and has a base to be attached to the end of the cylindrical body 25, and a side portion having a center axis orthogonal to the center axis of the base. To the end of the side portion, the supporting component 16 is attached.

Accordingly, the cooling section 20 has the cooling cylinder 22 of a certain length, with one longitudinal end (in this modified example, the end of the side portion of the interconnect component 26) opened; the inner space S which is formed as a result of closure of the opened end of the cooling cylinder 22 by the rear face 1604 of the mounting plate 16A, and extends in the perpendicular direction when the cooling cylinder 22 is held so as to direct the longitudinal direction thereof in the perpendicular direction; and the coolant liquid 28 filled in the inner space S.

The inner space S has a columnar space S1 which is sectioned in the cylindrical body 25 and straightly extends while keeping a constant sectional area, and a lower space S3 which is formed inside the interconnect component 26, connected to the longitudinal end of the columnar space S1, and has the center axis which crosses at right angles with the columnar space S1.

The coolant liquid 28 is filled as much to ensure that the entire range of the rear face 1604 of the mounting plate 16A is submerged in the coolant liquid 28 at all times, when the cooling cylinder 22 is held so as to direct the longitudinal direction thereof in the perpendicular direction. For example, the coolant liquid 28 is filled up to the lower end of the columnar space S1.

Also in this modified example, when viewed from the direction of thickness of the mounting plate 16A, the plurality of mounted LED elements 14 are located inside the range of the rear face 1604 located in the inner space S, and the large number of discrete recesses 1610, each concaving towards the mounting surface 1602, are formed in a honeycomb pattern over the entire area of the mounting plate 16A located in the inner space S.

Accordingly, also this modified example is much advantageous like the embodiment described above, in terms that the heat generated from the LED elements 14 is effectively conducted through the thin wall 1620 which configures the bottom face 1610A of the recesses 1610, and thereby the LED elements 14 are effectively cooled.

It is apparent that the present invention is not limited to the embodiments described above.

For example, while not specifically illustrated in the LED illumination device 2 of the embodiment, the LED elements 14 may be configured to be protected by a component capable of surrounding them. For example, it is possible to surround them with a semi-translucent protective component which is generally used for electric bulb or the like. By using the protective component depending on purposes, it now becomes possible to protect the light emitting section or to control intensity of the illumination light.

Having described the LED illumination device 2 of the embodiment, in which the cooling cylinder 22 was configured to contain the cylindrical body 25 and the radiation fins 24, the geometry of the cooling section 20 is not limited to that described in the embodiment, so long as the coolant liquid 28 may circulate therein by gravity, and may be selectable depending on purposes.

Having described the substrate 12 shaped as a disk, also the geometry of the substrate 12, and the entire shape of the illumination section 10 are not limited to those described in the embodiment.

Having described the LED illumination device 2 of the embodiment configured as a pendant-type one, the present invention is also applicable to other types of illumination device such as downlight-type one recessed in ceiling.

REFERENCE SIGNS LIST

2 . . . LED illumination device, 10 . . . illumination section, 12 . . . substrate, 14 . . . LED element, 16 . . . supporting component, 16A . . . mounting plate, 1602 . . . mounting surface, 1604 . . . rear face, 1610 . . . recess, 16B . . . reflector, 20 . . . cooling section, 22 . . . cooling cylinder, 24 . . . radiation fin, 25 . . . cylindrical body, 26 . . . interconnect component, S . . . inner space, 28 . . . coolant liquid.

The invention claimed is:

1. An LED illumination device comprising:

an illumination section which has a substrate with a plurality of LED elements mounted thereon, and a mounting plate which supports the substrate; and a cooling section which supports and cools the mounting plate, the cooling section comprising:

a cooling cylinder, which includes a cylindrical body with one longitudinal end and an other longitudinal end, and the one longitudinal end is closed and the other longitudinal end is open, and a hollow interconnect component is attached to the other longitudinal end of the cylindrical body;

and a coolant liquid filled within the cooling cylinder, the mounting plate having one surface when viewed in a direction of thickness of the mounting plate configured as a mounting surface on which the substrate is attached, and the other surface when viewed in the direction of thickness of the mounting plate configured as a rear face, the mounting plate having a plurality of discrete recesses, each concaving towards the mounting surface, being formed in a honeycomb pattern over the entire rear face positioned within the cooling cylinder;

a bottom wall positioned between corresponding bottom surfaces of the plurality of recesses and the mounting surface; and partition walls which are positioned between adjacent ones of the plurality of recesses, extending over the mounting surface and the rear surface, and partitioning the plurality of recesses, the partition wall wherein a part thereof positioned in an outer periphery and another part thereof positioned in the center of the rear surface within the cooling cylinder are connected, a height of the partition wall form the bottom surface of the recesses being greater than a thickness of the bottom wall and being formed in a dimension that suffices to give the mounting plate rigidity that prevents the mounting plate from being deformed against a saturated vapor pressure of the coolant liquid that acts on the mounting plate or against a vacuum state or a reduced pressure, which is near vacuum, when the coolant liquid is injected into the cooling cylinder, and the plurality of LED elements being disposed so as to fall within the contour of the recesses, when viewed in the direction of the thickness of the mounting plate;

wherein the mounting plate is attached, in such a manner that the rear surface thereof is directed toward the inside of the interconnect component, to one end of the interconnect component, the one end being opposed to a location thereof with which the interconnect component is attached to the other longitudinal end of the cylindrical body, thereby to close the one end of the interconnect component, wherein an area of a location of the rear surface, the location being positioned inside the one end of the interconnect component, is greater than an area of a cross section of an inside space of the cylindrical body, the cross section being taken along a plane perpendicular to an axial direction of the cylindrical body, wherein an inner space of the cooling cylinder includes a columnar space that is formed inside the cylindrical body and straightly extends while keeping a constant cross-sectional area, and a first space that is formed inside the interconnect component, connected to the columnar space, and has a cross-sectional area that gradually increases with distance as closer to the rear surface, the cross-sectional area being taken along a plane in parallel with the rear surface, and wherein an entire region of the rear surface of the mounting plate positioned within the cooling cylinder is an entire area of the mounting plate positioned within the first space.

2. The LED illumination device of claim 1, wherein each recess has a bottom face, and a side face which rises up from the circumference of the bottom face to be connected to the rear face, and the boundary between the bottom face and the side face is connected by a concave curved face.

3. The LED illumination device of claim 1, wherein, while keeping the cooling cylinder so as to direct the longitudinal direction thereof in the perpendicular direction, the rear face is faced upward in the perpendicular direction, and the mounting surface and the LED elements are faced downward in the perpendicular direction, and wherein the cooling section contains a plurality of fins provided with a contour, disposed so that in the plan view the contour thereof falls within the contour of the illumination section, in the plan view.

4. The LED illumination device of claim 1, wherein, while keeping the cooling cylinder so as to direct the longitudinal direction thereof in the perpendicular direction, the rear face, the mounting surface and the LED elements are inclined away from the perpendicular direction.

5. The LED illumination device of claim 1, wherein the illumination section is configured to have a reflector provided around the mounting plate, and the cooling section is configured to have a plurality of fins provided so as to protrude out from the outer circumferential surface of the cooling cylinder.

6. The LED illumination device of claim 1, wherein the one longitudinal end of the cylindrical body is closed with a seal in which an injection hole for the coolant liquid is formed, wherein the seal is welded with the cylindrical body, wherein the cylindrical body and the interconnect component are welded with each other, wherein the interconnect component and the mounting plate is welded with each other, and wherein the injection hole is closed by welding after the coolant liquid is injected into the inner space.

* * * * *